US008201631B2

(12) United States Patent
Stromquist et al.

(10) Patent No.: US 8,201,631 B2
(45) Date of Patent: Jun. 19, 2012

(54) MULTI-FUNCTIONAL ISOLATION TOOL AND METHOD OF USE

(75) Inventors: Marty Stromquist, Calgary (CA); Donald Getzlaf, Calgary (CA)

(73) Assignee: NCS Oilfield Services Canada Inc., Calgary (CA)

( * ) Notice: Subject to any disclaimer, the term of this patent is extended or adjusted under 35 U.S.C. 154(b) by 0 days.

(21) Appl. No.: 13/078,584

(22) Filed: Apr. 1, 2011

(65) Prior Publication Data

US 2012/0055671 A1 Mar. 8, 2012

(51) Int. Cl.
*E21B 43/26* (2006.01)
*E21B 43/11* (2006.01)

(52) U.S. Cl. ..... 166/308.1; 166/387; 166/298; 166/127

(58) Field of Classification Search ..... 166/308.1, 166/387, 298, 127, 147, 55
See application file for complete search history.

(56) References Cited

U.S. PATENT DOCUMENTS

| | | | | |
|---|---|---|---|---|
| 2,212,743 | A | 8/1940 | Kremmling | |
| 2,458,433 | A | 1/1949 | Arterbury et al. | |
| 2,670,218 | A | 2/1954 | Rokahr | |
| 2,683,432 | A | 7/1954 | Schanz | |
| 3,381,749 | A * | 5/1968 | Chenoweth | 166/55 |
| 3,430,701 | A | 3/1969 | Canada | |
| 3,648,777 | A | 3/1972 | Arterbury et al. | |
| 4,501,331 | A | 2/1985 | Brieger | |
| 4,834,183 | A | 5/1989 | Vinzant et al. | |
| 4,940,094 | A | 7/1990 | Lessi et al. | |
| 4,953,617 | A | 9/1990 | Ross et al. | |
| 5,033,551 | A | 7/1991 | Grantom | |
| 5,353,875 | A | 10/1994 | Schultz et al. | |
| 5,472,049 | A | 12/1995 | Chaffee et al. | |
| 5,755,286 | A | 5/1998 | Ebinger | |
| 6,024,173 | A | 2/2000 | Patel et al. | |
| 6,543,538 | B2 | 4/2003 | Tolman et al. | |
| 6,695,057 | B2 | 2/2004 | Ingram et al. | |
| 6,915,856 | B2 | 7/2005 | Gentry et al. | |
| 7,051,812 | B2 | 5/2006 | McKee et al. | |
| 7,059,407 | B2 | 6/2006 | Tolman et al. | |
| 7,225,869 | B2 | 6/2007 | Willett et al. | |
| 7,278,486 | B2 | 10/2007 | Alba et al. | |
| 7,516,792 | B2 | 4/2009 | Lonnes et al. | |
| 7,789,163 | B2 * | 9/2010 | Kratochvil et al. | 166/387 |
| 7,896,082 | B2 | 3/2011 | Lake et al. | |
| 2002/0162660 | A1 | 11/2002 | Depiak et al. | |

(Continued)

FOREIGN PATENT DOCUMENTS

CA 2212743 A1 6/1997

(Continued)

OTHER PUBLICATIONS

International Search Report for application PCT/CA2011/001167 dated Feb. 8, 2012.

(Continued)

*Primary Examiner* — Daniel P Stephenson
(74) *Attorney, Agent, or Firm* — Honigman Miller Schwartz and Cohn LLP

(57) ABSTRACT

A tool assembly and method for completing a well are provided. The tool is deployed on tubing string and includes a fluid treatment assembly with cup seals above and below the treatment ports. An equalization valve beneath the fracturing assembly can be opened or closed to control fluid passage between the coiled tubing and treatment zone to the wellbore below.

27 Claims, 6 Drawing Sheets

U.S. PATENT DOCUMENTS

| | | | |
|---|---|---|---|
| 2005/0072577 | A1 | 4/2005 | Freeman |
| 2005/0150661 | A1 | 7/2005 | Kenison et al. |
| 2005/0236154 | A1 | 10/2005 | Tudor et al. |
| 2006/0124310 | A1 | 6/2006 | Lopez de Cardenas et al. |
| 2006/0180319 | A1 | 8/2006 | Lucas et al. |
| 2009/0159299 | A1 | 6/2009 | Kratochvil et al. |

FOREIGN PATENT DOCUMENTS

| | | | |
|---|---|---|---|
| EP | 589687 | A2 | 3/1994 |
| WO | WO-2008093047 | A1 | 8/2008 |
| WO | WO-2011116207 | A1 | 9/2011 |

OTHER PUBLICATIONS

International Search Report for Application PCT/CA2011/000988 mailed Oct. 17, 2011.
"Z-Frac Straddle packer" brochure information (3 pages).
Innicor Tool Information (3 pages).
Office Action dated Jan. 17, 2011 from Canadian Intellectual Property Office for Serial No. 2,713,611.
"Sand Jet Perforating Revisited", SPE Drill & Completion, vol. 14, No. 1 Mar. 1999, J.S. Cobbett, pp. 28-33.
"Tubing-Conveyed Perforating With Hydraulic Set Packers and a New High-Pressure Retrievable Hydraulic Packer" SPE 13372, Hailey and Donovan 1984.
"Advances in Sand Jet Perforating", SPE 123569, Dotson, Far and Findley, 2009, pp. 1-7.
"High-Pressure/High-Temperature Coiled Tubing Casing Collar Locator Provides Accurate Depth Control for Single-Trip Perforating" SPE 60698, Connell et al, 2000, pp. 1-9.
"Investigation of Abrasive-Laden-Fluid Method for Perforation and Fracture Initiation" Journal of Petroleum Technology, Pittman, Harriman and St. John, 1961, pp. 489-495.
"Sand Jet Perforating Revisited" SPE 39597, Cobbett 1998, pp. 703-715.
"Single-Trip Completion Concept Replaces Multiple Packers and Sliding Sleeves in Selective Multi-Zone Production and Stimulation Operations" SPE 29539, Coon and Murray 1995, pp. 911-915.

* cited by examiner

MULTI-FUNCTIONAL ISOLATION TOOL AND METHOD OF USE

FIELD OF THE INVENTION

The present invention relates generally to oil and gas well completion. More particularly, the present invention relates to a tool string for use in perforating, isolating, and fracturing multiple intervals of a gas, oil, or coal bed methane wellbore in a single trip downhole.

BACKGROUND OF THE INVENTION

Tools for use downhole in the completion of a wellbore are generally well known. For example, perforation devices are commonly deployed downhole on wireline, cable, or on tubing string, and sealing devices such as bridge plugs and straddle packers are commonly used to isolate portions of the wellbore during fluid treatment. As such, tools are exposed to varying conditions during use, and improvements have evolved over time to address problems typically encountered downhole.

The Applicants have previously described a tool and method for use in the perforation and treatment of multiple wellbore intervals. That tool included a jet perforation device and sealing assembly, with an equalization valve for controlling fluid flow through and about the assembly. Fluid treatment is applied down the wellbore annulus to treat the uppermost perforated zone.

When multiple pre-existing perforations are to be treated, application of the treatment fluid down the wellbore annulus is not desirable, as perforations cannot be treated selectively by this method. Typically, an isolation device is required. Cup seals are known for use in straddle tools and other isolation tools, but are not well suited for applications requiring repeated use in a single run downhole due to the risk of wear and failure should the tool assembly slide within the wellbore while the seals are set. This risk is greater in applications where sand or other debris is present downhole, as the cup seals may fail to fully seal against the casing in the presence of sand or other solids, leading to sliding of the seals and premature wear.

Use of any sealing device in the presence of significant amounts of sand or other solids increases the risk of tool malfunction. Further, the tool may become stuck downhole should a solids blockage occur during treatment, or when the formation expels solids upon release of hydraulic pressure in the wellbore annulus when treatment is complete. Typical completion assemblies have many moving components to provide actuation for various downhole functions, and the presence of sand or other solids within these actuation mechanisms would risk jamming these mechanisms, potentially causing a malfunction or permanent damage to the tool or well. Correcting such a situation is costly, and poses significant delays in the completion of the well. Accordingly, well operators, fracturing companies, and tool suppliers/service providers are typically very cautious in their selection of fluids and tools for use in completion operations.

SUMMARY OF THE INVENTION

In a first aspect, the present invention provides a completion tool for deployment within a wellbore on tubing string, the assembly comprising: upper and lower sealing members defining a straddle zone between the upper and lower sealing members; one or more treatment ports within the straddle zone, the treatment ports continuous with tubing string to allow fluid delivery to the wellbore from surface; a valve housing mounted beneath the lower sealing member, the valve housing defining a fluid passageway continuous with the tubing string and with the wellbore annulus beneath the lower sealing member to allow pressure equalization therebetween; a bypass plug slidable within the valve housing between an open position in which fluid passage through the housing is permitted, and a sealed position in which fluid passage through the housing is prevented, the plug actuable to open or to seal the passageway upon application of mechanical pressure to the tubing string; and a resettable anchor device operatively mounted beneath the lower sealing member for setting against the casing of a wellbore, the anchor device operable by application of mechanical force to the tubing string.

In various embodiments, the sealing members may be cup seals, inflatable sealing elements, compressible sealing elements, or other mechanical or hydraulically actuated sealing members.

In one embodiment, the anchor device comprises one or more anchoring slips disposed about a mandrel of the anchor device, and an actuation cone slidable with respect to the mandrel of the anchor device to engage the inwardly biased slips and drive said slips outward to engage the casing, thereby anchoring the tool assembly against the casing. The anchor may be actuated from surface by application of a mechanical force to the tubing string. Where the tubing string is coiled tubing, the mechanical force is an uphole or downhole force.

In another embodiment, the anchor is actuated from surface by application of mechanical force to the tubing string. For example, the application of mechanical force to the tubing string may drive movement of a pin within an auto J profile, the auto J profile having pin stop positions corresponding to at least two operable positions of the anchor device.

In a further embodiment, the anchor device further comprises a mechanical casing collar locator for providing frictional resistance against which the anchor device may be operated by application of mechanical force to the tubing string from surface.

In an embodiment, the completion tool further comprises one or more jet perforation nozzles formed within the assembly below the valve housing.

In accordance with a second aspect of the invention, there is provided a completion tool for deployment within a wellbore on tubing string, the assembly comprising: a straddle assembly comprising upper and lower sealing members defining a straddle zone; one or more treatment ports within the straddle zone of the straddle assembly, the treatment ports continuous with tubing string to allow fluid delivery to the wellbore from surface; a jet perforation device operatively attached below the straddle assembly, the jet perforation device comprising a tubular having one or more jet perforation nozzles continuous with the tubing string; a valve housing between the straddle assembly and the jet perforation device, the valve housing defining a fluid passageway between the straddle assembly and the jet perforation device; and a bypass plug slidable within the valve housing between an open position in which fluid passage through the housing to the jet perforation device is permitted, and a sealed position in which fluid passage through the housing is prevented, the plug actuable to open or to seal the passageway upon application of mechanical pressure to the tubing string.

In an embodiment, the completion tool further comprises a resettable anchor device for engaging the casing of a wellbore, the anchor device operable by application of mechanical force to the tubing string.

The anchor device may comprise one or more anchoring slips disposed about a mandrel of the anchor device, and an actuation cone slidable with respect to the mandrel of the anchor device to engage the inwardly biased slips and drive said slips outward to engage the casing, thereby anchoring the tool assembly against the casing. In a particular embodiment, the anchor may be actuated from surface by application of mechanical force to the tubing string, said mechanical force driving movement of a pin within an auto J profile, the auto J profile having pin stop positions corresponding to at least two slidable positions of the actuation cone.

In an embodiment, the anchor device further comprises a mechanical casing collar locator for providing frictional resistance against which the anchor device may be operated by application of mechanical force to the tubing string from surface.

In accordance with a third aspect of the invention, there is provided a method for treating a wellbore, the method comprising the steps of:

providing a tool assembly comprising: upper and lower sealing members mounted along a mandrel, defining a straddle zone between the upper and lower sealing members; one or more treatment ports within the straddle zone for delivery of treatment fluid to the wellbore from the tubing string; a valve housing mounted beneath the lower sealing members, the valve housing defining a fluid passageway continuous with the tubing string and with the wellbore annulus beneath the lower sealing member to allow pressure equalization therebetween; a bypass plug slidable within the valve housing between an open position in which fluid passage through the housing is permitted, and a sealed position in which fluid passage through the housing is prevented, the plug actuable to open or to seal the passageway upon application of a mechanical force to the tubing string; and a resettable anchor device operatively mounted beneath the lower sealing member for engaging the casing of a wellbore, the anchor device operable by application of mechanical force to the tubing string; locating the completion tool downhole at a position in which the upper and lower sealing members straddle a casing perforation to be treated;

sealing the fluid passageway through the valve housing;

applying mechanical force to the tubing string to set the anchor against the casing; and applying treatment fluid to the tubing string to isolate and treat the perforation.

In an embodiment, the method further comprises the step of unsealing the fluid passageway through the valve housing to equalize hydraulic pressure across the lower sealing member.

In another embodiment, the method further comprises the step of unsetting the anchor from the casing.

Any one or more steps may be repeated within a single wellbore as desired, without removing the tool assembly from the wellbore.

In accordance with a fourth aspect of the invention, there is provided a method for treating a wellbore, the method comprising the steps of:

providing a completion tool comprising: a straddle assembly comprising upper and lower sealing members defining a straddle zone; one or more treatment ports within the straddle zone, the treatment ports continuous with tubing string to allow fluid delivery through the treatment ports from surface; a jet perforation device operatively attached below the straddle assembly, the jet perforation device comprising a tubular having one or more jet perforation nozzles continuous with the tubing string; a valve housing between the straddle assembly and the jet perforation device, the valve housing defining a fluid passageway between the straddle assembly and the jet perforation device; and a bypass plug for reversibly sealing the fluid passage through the housing, the plug operable upon application of mechanical pressure to the tubing string;

locating the completion tool downhole adjacent a zone of interest; and applying fluid to the tubing string.

In an embodiment, the fluid passageway between the straddle assembly and the jet perforation device is sealed when fluid is applied to the tubing string such that the fluid is applied only to the wellbore adjacent the straddle zone.

In another embodiment, the fluid passageway between the straddle assembly and the jet perforation device is unsealed when the fluid is applied to the tubing string, such that fluid is applied to the wellbore adjacent the straddle zone and also through nozzles in the jet perforation device.

In another embodiment, the tool further comprises a resettable anchor device operatively attached beneath the lower sealing member, for engaging the casing of a wellbore to stabilize the tool within the casing, the anchor device operable by application of mechanical force to the tubing string; and wherein the method further comprises the step of applying mechanical force to the tubing string to set the anchor against the casing.

In accordance with a fifth aspect of the invention, there is provided a method for perforating and treating a wellbore, the method comprising the steps of:

providing a bottom hole assembly deployed on tubing string, the bottom hole assembly comprising a straddle isolation device, a sand jet perforating device, and a fluid bypass valve between the isolation tool and the sand jet perforating device;

setting the straddle isolation device downhole about a perforation to be treated;

pumping fluid down the tubing string with the bypass valve closed, to prevent said fluid from reaching the jet perforation device;

once treatment of the perforation is complete, opening the bypass valve to allow hydraulic pressure to be dissipated across the straddle device.

In an embodiment, the step of setting the straddle isolation device comprises setting upper and lower cup seals about a straddle zone.

In an embodiment, the method further comprises the steps of:

identifying a wellbore interval to be perforated;

locating the bottom hole assembly within the wellbore interval to be perforated;

sealing the bypass valve; and pumping abrasive fluid down the tubing string to perforate the wellbore interval.

In an embodiment, the method further comprises repeating any one or more steps without removing the completion tool from the wellbore.

In an embodiment, the method further comprises the step of actuating a resettable anchor device against the casing of the wellbore to stabilize the tool within the casing. The step of actuating the resettable anchor may comprise a step of application of a mechanical force to the tubing string.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figure 1:
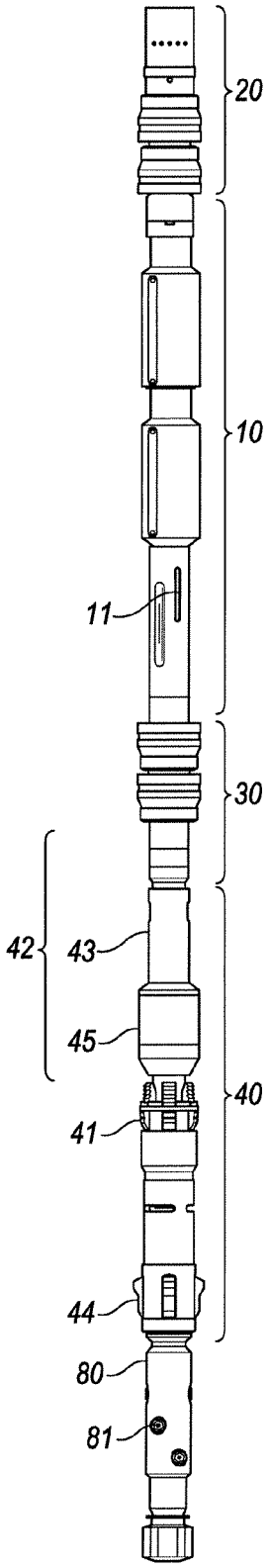
FIG. 1 is a perspective view of a tool assembly in accordance with one embodiment.

Generally, a downhole assembly and method are provided for use in fracturing multiple intervals of a wellbore without removing the tool string from the wellbore between intervals. This system may generally be used in vertical, deviated, horizontal, or branched oil and gas wells having cased wellbores.

In the present description, the terms "above/below" and "upper/lower" are used for ease of understanding, and are generally intended to mean the uphole and downhole direction from surface. However, these terms may be imprecise in certain embodiments depending on the configuration of the wellbore. For example, in a horizontal wellbore one device may not be above another, but instead will be closer (uphole, above) or further (downhole, below) from the point of entry into the wellbore. Likewise, the term "surface" is intended to mean the point of entry into the wellbore, that is, the work floor where the assembly is inserted into the wellbore.

Jet perforation, as mentioned herein, refers to the technique of delivering abrasive fluid at high velocity so as to erode the wall of a wellbore at a particular location, creating a perforation. Typically, abrasive fluid is jetted from nozzles arranged about a mandrel such that the high rate of flow will jet the abrasive fluid from the nozzles toward the wellbore casing. Sand jetting refers to the practice of using sand as the abrasive agent, in an appropriate carrier fluid. For example, typical carrier fluids for use in sand jetting compositions may include one or more of: water, hydrocarbon-based fluids, propane, carbon dioxide, nitrogen assisted water, and the like.

The presently described assembly may be deployed within a wellbore on tubing string, wireline, cable, or by other suitable suspension or carriage. The embodiments of the assembly depicted in the Figures are shown and described as being deployed on tubing string, such as coiled tubing. However, other types of tubulars (for example threaded pipe) or other suspension systems (wireline, cable, etc.) may be suitable depending on the application.

Overview

Generally, the assembly may be deployed on tubing string such as jointed pipe, concentric tubing, or coiled tubing. The assembly will typically include upper and lower isolation elements, a fracturing port between the isolation elements, and an anchoring device below the lower isolation element. A jet perforation device may also be present below the lower isolation element.

An anchoring device is provided, in some embodiments, for stability in setting the tool, and to prevent sliding of the tool assembly within the wellbore during treatment. Further, the anchoring device allows controlled actuation of the equalization valve/plug within the housing by application of mechanical pressure to the tubing string from surface. Suitable anchoring devices may include drag blocks, mechanical slips, packers, and other anchor devices known in the art. Simple mechanical actuation of the anchor is generally preferred to provide adequate control over setting of the anchor, and to minimize failure or debris-related jamming during setting and releasing the anchor. Mechanical actuation of the anchor assembly is loosely coupled to actuation of the bypass valve, allowing coordination between these two slidable mechanisms. The presence of a mechanical casing collar locator, or other device providing some degree of friction against the casing, is helpful in providing resistance against which the anchor and bypass/equalization valve may be mechanically actuated.

Various sealing devices for use within the tool assembly to isolate the zone of interest are available, including friction cups, inflatable packers, and compressible sealing elements. In the particular embodiments illustrated and discussed herein, friction cups are shown straddling the fracturing/treatment ports of the tool. When a jet perforation device is also present within the tool assembly, these friction cups also act as an anchor for the tool assembly during jet perforation as will be described below.

While the presently described embodiments employ cup seals to isolate wellbore intervals, and may further incorporate an anchor assembly to secure the position of the tool at each interval prior to fracturing, alternate selections and arrangement of the assembly components may be made in accordance with the degree of variation and experimentation typical in this art field.

With reference to FIG. 1, a fracturing or treatment assembly 10 is provided for delivering fracturing fluid (or other treatment fluid) to a wellbore interval of interest through the tubing string. Double cup assemblies 20, 30, straddle the fracturing assembly 10 and seal against the casing upon delivery of pressurized treatment fluid to the wellbore interval. An anchor assembly 40 engages the casing below the isolated interval. Fluid jetting device 80 (when present) may be utilized to deliver high velocity abrasive fluid through jet nozzles 81 to form perforations in the wellbore when necessary.

The tool string is assembled and deployed downhole on tubing (for example coiled tubing or jointed pipe) to a wellbore interval of interest. The anchor is then set against the casing, and fluid is pumped down the tubing under pressure, exiting the tubing string at frac ports 11. This results in flaring of the friction cups 20, 30, with the flared cups sealing against the casing.

If fracturing, or other fluid treatment, is desired, the bypass valve 43 is closed and the friction cups are located about a perforated portion of the wellbore. The closed bypass valve prevents fluid from passing down the tool string to the jet perforation device 80. Accordingly, the fluid delivered to the assembly will exit the ports 41 and pressurize the straddled interval, delivering treatment fluid to the zone through the isolated perforations. When treatment is terminated, the bypass valve 43 is pulled open to release pressure from the isolated zone, allowing fluid and debris to flow downhole through the bottom portion of the tool string. Pressure within the tubing string may also be dissipated, if necessary, from surface. Once the pressure within the fractured zone is relieved, the cup seals relax to their running position. The anchor is then unset and the tool string can be moved to the next interval of interest or retrieved from the wellbore.

If perforation of the wellbore is desired, the bypass valve 43 is open and the friction cups are set across the wellbore above the zone to be perforated. Pumping abrasive fluid down the tubing string will deliver fluid preferentially through the treatment ports 11 until the friction cups seal against the wellbore. As this interval is unperforated, this interval remains pressurized and thus acts as an anchor, securing the position of the tool assembly within the wellbore. Further fluid delivery will be reach the perforation device and exit at jet nozzles 81, resulting in jetting of abrasive fluid against the casing to perforate the wellbore adjacent the jet nozzles.

As the environment in which the present tool string is used may be sand-laden (due to the formation characteristics, use of abrasive fluids and/or proppant-laden treatment fluids), there is a significant risk that debris may accumulate within the apertures, slots, chambers, and moving parts of the tool during deployment. For example, solids may accumulate over the cups and anchor.

Accordingly, debris relief features may be incorporated into the tool, as discussed in copending application U.S. Ser. No. 12/708,709, which is incorporated herein by reference in its entirety.

Assembly

Figure 5:
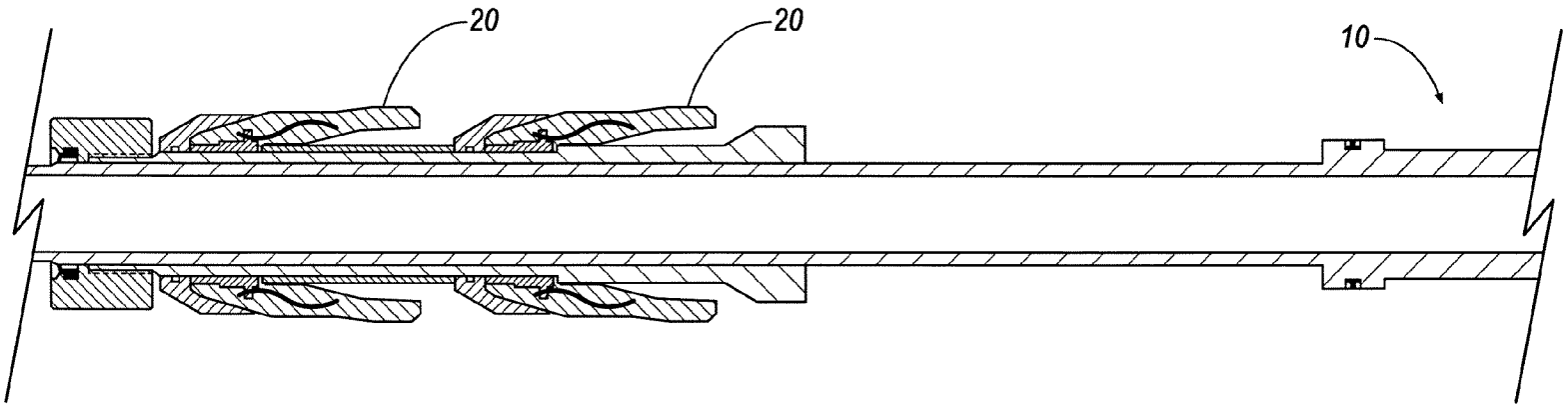
FIG. 5 is a schematic cross sectional view of an upper portion of a tool assembly having slidable upper cup seals.

With reference to the assembly shown in FIG. 1, the upper 20 and lower 30 cup seals generally define the zone to be isolated for fluid treatment. The spacing of these seals is predetermined prior to assembly and may be customized for each run downhole. The upper seals 20 are slidably disposed above the fracturing assembly 10 as shown in FIG. 5. The lower cup seals 30 are assembled between the treatment ports 11 and the anchor assembly 40. A fluid jetting device 80 may also be assembled below the lower cup seals 30.

The depicted fracturing assembly 10 also includes a blast joint(s), and a centralizer. Additional tool string components may also be present. Fluid delivery ports/frac ports 11 in the fracturing assembly allow for delivery of fluid to the wellbore from surface.

Figure 2:
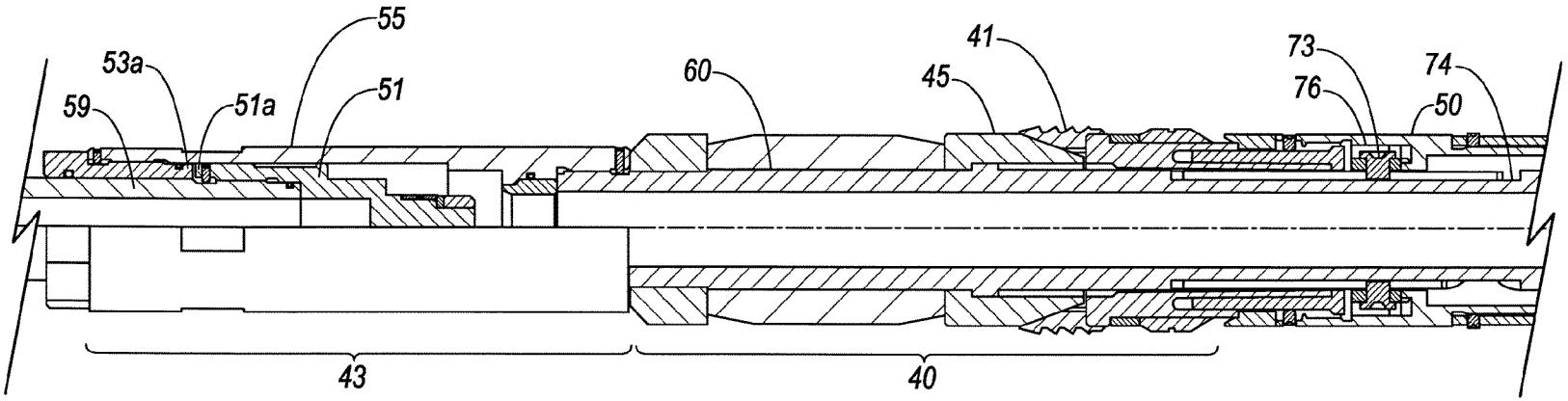
FIG. 2 is a schematic cross sectional view of a portion of a tool assembly having an equalization valve and anchor assembly.

The anchor assembly 40 includes an anchor device 41 and actuator assembly (in the present drawings represented by cone element 45), a bypass/equalization valve 43, and a casing collar locator 44. As shown in the Figures, the anchor device 41 may be a set of mechanical slips driven outwardly against the casing. In the embodiment shown in the Figures, the slips are driven outwardly by downward movement of the cone element 45. The bypass assembly and anchor actuator shown in FIG. 1 are controlled from surface by applying a mechanical force to the coiled tubing, which drives a pin 73 within an auto J profile 74 about the actuator assembly mandrel 60. This is shown best in FIGS. 2 and 4.

Suitable anchoring devices may include inflatable packers, compressible packers, drag blocks, and other anchoring devices known in the art. For example, known anchoring devices include mechanically set or hydraulically set anchors having cone-driven undirectional slips or bidirectional slips.

The anchor device 41 and actuator assembly 42 shown in the Figures was created from a mechanical-set compressible packer assembly. That is, the packer was modified to replace the compressible packer element with a non-compressible steel cone 45 of appropriate size to engage the slips 41. When placed downhole at an appropriate location, the fingers of mechanical casing collar locator 44 provide sufficient drag resistance for manipulation of the auto J mechanism of the actuator assembly 42 by application of force to the tubing string. When the pin 73 is driven towards its downward-most pin stop 79*a* in the J profile, the cone 45 is driven against the slips, forcing them outward against the casing, acting as an anchor within the wellbore. When fracturing is complete, or anchoring is otherwise no longer necessary, the cone 45 is removed from engagement with the inwardly-biased slips by manipulation of the pin within the J profile to the release position 79*b*, allowing retraction of the slips 41 from the casing. Anchoring of the assembly within the wellbore ensures appropriate placement of fluid treatment and also prevents sliding of the cup seals within the wellbore, which may otherwise lead to premature wear, as is often responsible for the failure of cup seals in other tools.

During jet perforation, the anchor is typically unset and the bypass is open. When fluid pressure is applied the cup seals will engage the casing, and the tool string will remain fixed, stabilizing the jet sub while abrasive fluid is jetted through nozzles 81.

Opening and Closing of Bypass Valve

The bypass assembly is a modified version of the equalization valve described in Applicant's copending application U.S. Ser. No. 12/708,709. Notably, the bypass provides a central fluid passageway from the tubing to the lower wellbore. Bypass plug 51 is slidable within the assembly upon application of force to the tubing string, to open and close the passageway. Notably, while the states of the bypass and anchor are both dependent on application of force to the tubing string from surface, the bypass plug is actuated initially without any movement of the pin 73 within the J slot 74.

To initiate isolation and treatment of the wellbore interval of interest, the anchor is set, closing the bypass valve and stabilizing the wellbore. A volume of treatment fluid is delivered through the tubing string under pressure, which will cause the cup seals to set against the casing. Further delivery of fluid will treat the interval as desired. When treatment is complete, pressure from the isolated zone is equalized across the anchor by opening the equalization or bypass valve 43. As fluid passes from the isolated zone through the bypass valve to equalize the pressure differential across the lower cup seal, the cup seals will unset from the casing. In the event that the upper cup seals do not unset simultaneously with the lower cup seals, or do not unset fully, the position of the tool assembly is maintained by the anchor remaining set against the casing. To unset the anchor, an uphole force is applied to the tubing string, physically driving the pin within the J-slot towards release position 79*b*.

When the equalization valve is open and the anchor is unset, movement of the tool assembly up or downhole is facilitated as wellbore fluids may circulate through the assembly as well as within the wellbore annulus, limiting hydraulic resistance to running in or out of hole.

Figure 3A:
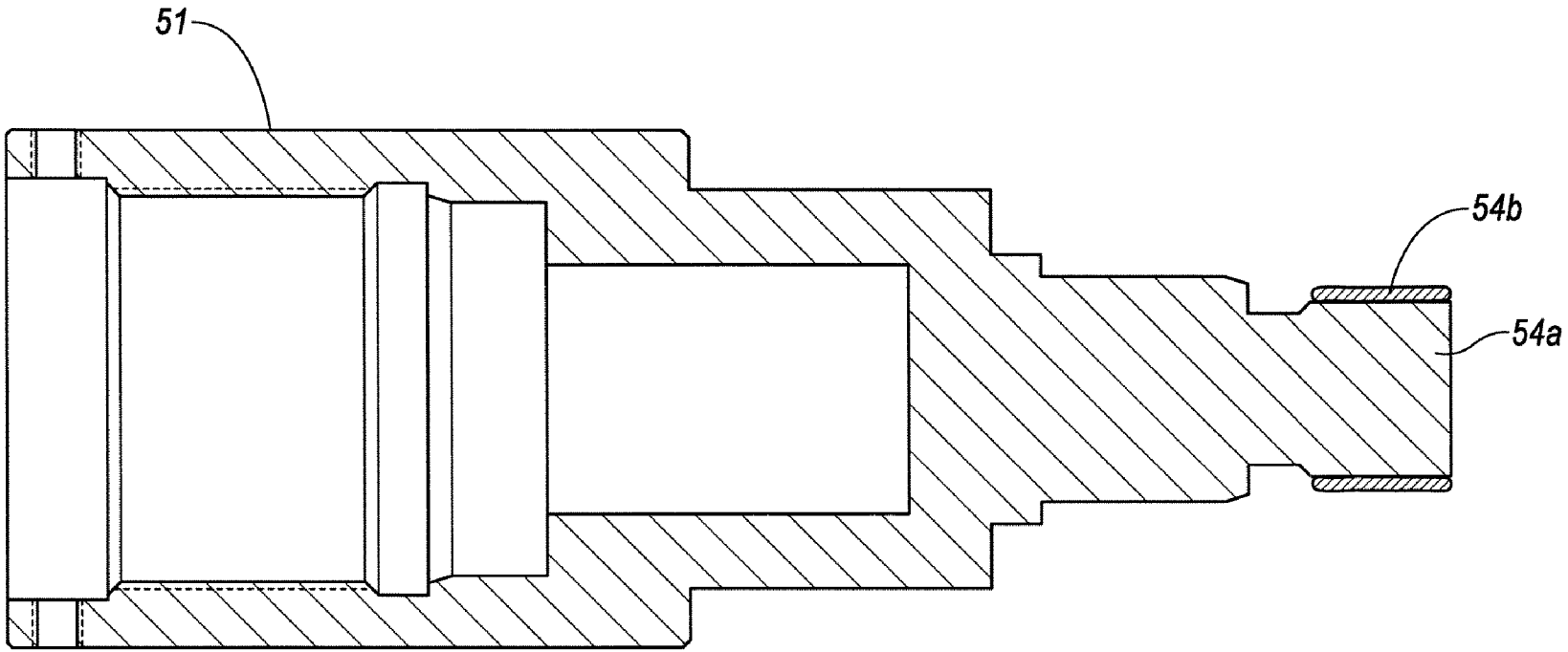
FIG. 3*a* is a schematic cross sectional view of the bypass plug 51 shown in FIG. 2.
Figure 3B:
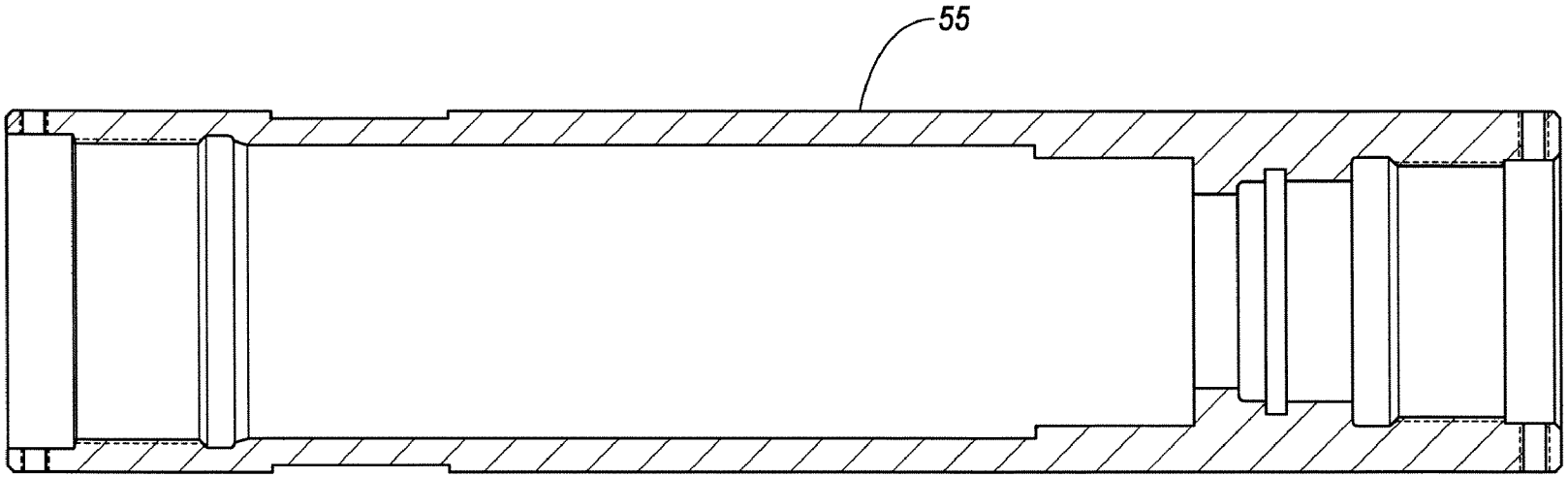
FIG. 3*b* is a schematic cross sectional of the equalization housing 55 shown in FIG. 2.

The bypass valve includes a bypass plug 51 slidable within an equalization valve housing 55 (see FIGS. 3*a* and 3*b*). Such slidable movement is actuated from surface by pulling or pushing on the tubing, which is anchored to the assembly by a main pull tube 59. The main pull tube is generally cylindrical and provides an open central passageway for fluid communication through the housing from the tubing. The bypass plug 51 is anchored over the pull tube 59, forming an upper shoulder 51*a* that limits the extent of travel of the bypass plug 51 within the valve housing 55. Specifically, an upper lock nut is attached to the valve housing 55 and seals against the outer surface of the pull tube 59, defining a stop 53*a* for abutment against the upper shoulder 51*a* of the bypass plug.

The lower end of the valve housing 55 is anchored over anchor mandrel 60, defining a lowermost limit to which the bypass plug 51 may travel within the valve housing 55. The bypass plug 51 is closed at its lower end 54*a*, and is overlaid with a bonded seal 54*b*. The solid plug end 54*a* and bonded seal 54*b* are sized to engage the inner diameter of the anchor mandrel 60, preventing fluid communication between wellbore annulus/tubing string and the lower wellbore when the bypass plug 51 has reached the lower limit of travel.

The engagement of the bonded seal 54*b* within the mandrel 60 prevents fluid passage, but may be removed to open the mandrel by applying sufficient pull force to the coiled tubing. This pull force is less than the pull force required to unset the anchor due to the slidability of the bypass plug 51 within the housing between the mandrel 60 and the pull tube stop 53*a*. Accordingly, the equalization valve may be opened by application of pulling force to the tubing string while the anchor device remains set against the wellbore casing. This allows equalization of pressure from the isolated zone and unsetting of the cup seals without slippage and damage to the cup seals while pressure is being equalized.

The mechanism for setting and unsetting the anchor involves applying a force (either uphole or downhole) to the coiled tubing, which is translated to pull tube 59. That is, a J profile 74 is formed about the assembly mandrel 60. Pin 73 is held in place over the mandrel (within the J-profile), for example by a one-piece or two-piece clutch ring 76. The rotational movement of the J-pin within the J profile is independent of the tubing string so as not to cause torque to build up within the tubing string. The clutch ring and J profile may each have debris relief openings for allowing passage of fluid and solids during sliding of the pin 73 within the J profile 74.

Figure 4:
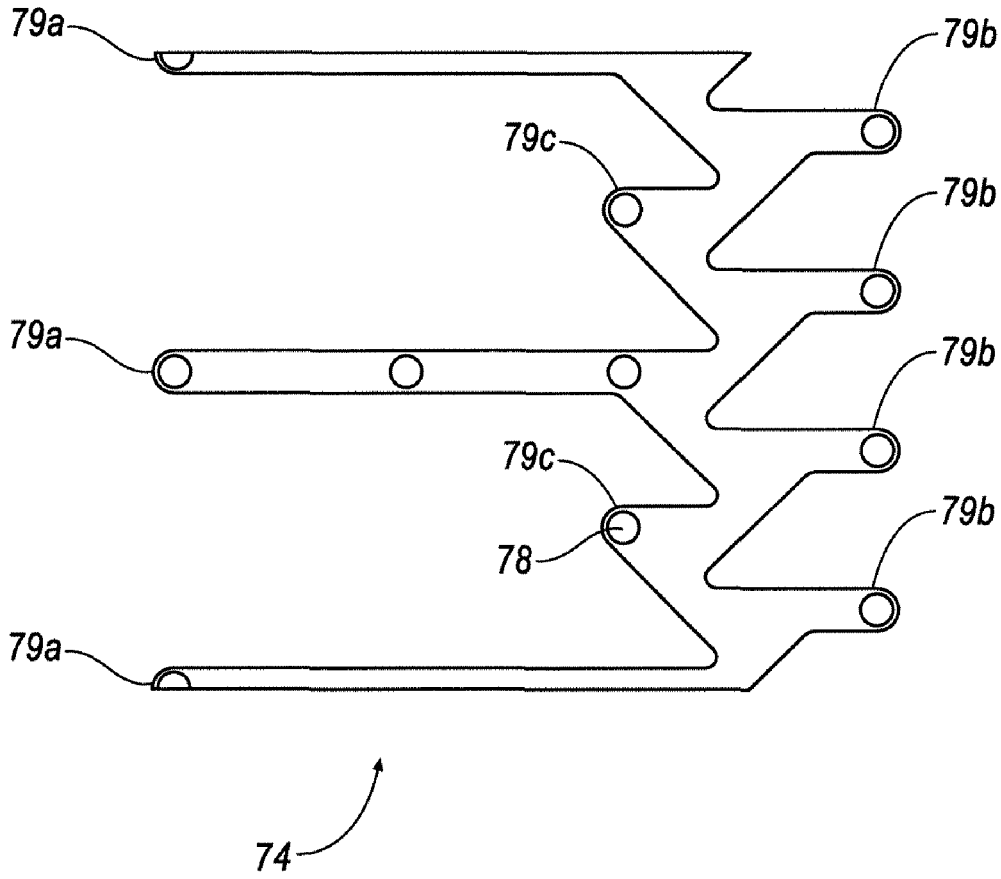
FIG. 4 is a diagram of the J-profile used to actuate the tool assembly shown in FIG. 2.

Various J profiles suitable for actuating downhole devices are known within the art. One suitable J profile 74 is shown in FIG. 4, having three sequential positions that are repeated about the mandrel. Debris relief apertures 78 may be present at various locations within the J-profile to permit discharge of settled solids as the pin 73 slides within the J profile. The J slots 74 are also deeper than would generally be required based on the pin length alone, which further provides accommodation for debris accumulation and relief without inhibiting actuation of the sealing device.

With reference to the J profile shown in FIG. 4, three pin stop positions are shown, namely an anchor set position 79*a*, a release position 79*b*, and a running-in position 79*c*. The assembly mandrel 60 is coupled to the pull tube 59, which is slidable with respect to the bottom sub mandrel 50 that holds the pin 73. The mechanical casing collar locator 44 generally drags against the casing and provides sufficient resistance to allow the pin 73 to slide within the J profile 74 as the pull tube 59 is manipulated from surface.

In the embodiment shown in the drawings, it is advantageous that the pull tube actuates both the bypass valve and the J mechanism for the anchor device, at varying forces to allow selective actuation. However, other mechanisms for providing this functionality may now be apparent to those skilled in this art field and are within the scope of the present teaching.

Components may be duplicated within the assembly, and placed as desired, for example by connecting one or more blast joints within the assembly. This spacing may be used to protect the tool assembly components from abrasive damage downhole, such as when solids are expelled from the perforations following pressurized treatment. For example, the blast joints may be positioned within the assembly to receive the initial abrasive fluid expelled from the perforations as treatment is terminated and the tool is pulled uphole.

Other methods for treatment of the perforations using the presently described tool string (with or without modification) are possible, using the knowledge and experience typical of operators in this field of art.

Method for Perforation

The tool assembly is run into the wellbore with pin 73 in the J-profile at the running in position 79. At this stop, the anchor is held in a position that does not allow the mechanical slips of the anchor to engage the casing. Accordingly, the drag of the mechanical casing collar locator and drag pads on the slips is overcome by application of weight to the tubing string, sliding the assembly downhole to a desired treatment position. It may be noted that the bypass plug would be sealed within the anchor mandrel as a result of the downward pressure on the pull tube and the resistance by the collar locator. Accordingly, the bypass is typically closed while running in hole.

In order to allow fluid delivered to the tubing string to reach jet nozzles 81, the bypass valve must be in the open position. It has been noted during use that when fluid is delivered to the bypass valve at high rates, the pressure within the valve typically tends to drive the valve open. That is, a physical force should be applied to hold the valve closed, for example by setting the anchor. Accordingly, when jet perforation is desired, the valve is opened by pulling the tubing string uphole to the perforation location. When fluid delivery is initiated with the bypass valve open, the hydraulic pressure applied to the tubing string (and through frac ports) will cause the cup seals to seal against the casing. If no perforation is present within that interval, the hydraulic pressure within the interval will be maintained between the cups, anchoring the tool assembly within the wellbore. Further pressurized fluid delivered to the tubing will thus not be taken up by the isolated interval, but will be forced/jetted through the nozzles 81. Fluid jetted from the nozzles will perforate or erode the casing and, upon continued fluid application, may pass down the wellbore and exit the wellbore, for example passing into a formation through perforations, open hole, or other mechanically placed openings in the wellbore. Typically, the fluid jetted from nozzles 81 will be abrasive fluid, as generally used in sand jet perforating techniques known in the prior art. It should be noted that in the present methods, the tool assembly is anchored during jetting by the set cup seals, and as a result, focussed perforations are jetted in the casing. This is in contrast with typical prior art methods that do not allow anchoring of the jetting assembly during abrasive perforation methods, and typically create slots or otherwise broad perforations in the casing due to movement of the device during jetting.

Once jetting is accomplished, fluid delivery is typically terminated and the pressure within the tubing string and straddled interval is dissipated. The tool may then be moved to initiate a further perforation, or a treatment operation.

Method for Fracturing

The anchor is set by applying a pulling force to the tubing string (and thereby to the pull tube) to cycle the anchor to release position 79*b*. The bypass valve is therefore opened during this pulling force, as the mechanical threshold force to operate the bypass is less than that required to cycle the pin within the auto J profile. A further downhole force applied to the tubing string will close the bypass valve again, and further, will drive the pin 73 towards anchor set position 79*a*, lowering the modified packer element 45 until it engages the mechanical slips 41, driving them outward against the casing. Once the position of the tool assembly downhole is thereby anchored and the bypass closed, a desired volume of fluid is delivered to the formation by pumping fluid through the coiled tubing. When the rate of fluid delivery to the coiled tubing results in high pressure fluid delivery from the frac ports 11, the hydraulic pressure at the fracturing assembly will exceed a cup seal threshold pressure and the cup seals will become flared outwards, sealing against the casing. The remainder of the wellbore therefore becomes isolated from the treatment interval for the remainder of the treatment application.

Once the treatment is successfully delivered to the isolated interval, the bypass plug may be unset by pulling on the tubing string. This will begin to allow equalization of pressure between the isolated interval and the wellbore beneath the anchor. Pressure within the tubing string may also be relieved at surface. Further pulling force on the tubing string will unset the anchor by sliding of the pin 73 to the unset position 79*b* in the J profile. The assembly may then be moved uphole to perforate and treat another interval.

In order to verify proper functioning of the cup seals and equalizing/bypass valve, a pressure test may be conducted in an unperforated wellbore segment prior to use or between treatments. That is, fluid is delivered while annulus pressure is monitored to endure the cups are properly sealing. Fluid flow into the perforations may also be tested.

Typically, the fluid bypass will be an equalization plug slidable within the valve housing. With reference to the example shown in the Figures, the plug may be moved from a sealed position—in which the cylindrical plug 54*a* and bonded seal 54*b* are engaged within the lower mandrel 60, and an unsealed position in which fluid may pass to and from the interval to the lower wellbore. The plug is operatively attached to pull tube 59, which may be actuated from surface to control the position of the equalization plug 51 within the valve housing 55.

The upper cups 20 are slidable with respect to the lower cups 30, as shown in FIGS. 1 and 5. In the event that debris has built up over the upper cup seal, an uphole force may still be applied to the tubing string to unseat the anchor due to the slidable upper seal assembly. That is, when high pressure fluid is first delivered through the frac ports, the upper cup seal will slide uphole prior to sealing against the casing. Accordingly, following treatment, if the upper cups fail to unset or should excessive debris be present above the upper cup seal, a pulling force applied to the tubing string will slide the upper cups down the tool to their lowermost position. This small amount of play in the position of the upper cup seals minimizes the risk of debris-related failure or of the tool.

A method for deploying and using the above-described tool assembly to perforate and fracture a wellbore is provided. The method typically includes the following steps:

- running a tool string downhole to a predetermined depth, the tool string having a ported mandrel between upper and lower sealing members, a bypass valve below the sealing members, a mechanical casing collar locator below the lower sealing members; and one or more jet perforation nozzles below the bypass valve;
- setting the sealing members against the wellbore casing to isolate the portion of wellbore between the sealing members;
- pumping a fluid down the tool string through the frac ports to the isolated wellbore;
- opening the bypass valve to equalize pressure across the lower sealing member; and
- moving the tool string within the same wellbore and repeating any or all of the above steps At locations where perforation of the casing is desirable, for example if previously placed ports or perforations are closed, or a new wellbore interval requires perforation, abrasive fluid is delivered to the assembly down the tubing string while the fluid bypass is open. The abrasive fluid will simultaneously be delivered to the wellbore via the frac ports, setting the upper and lower cup seals, and to a minimal extent through the jet nozzles. Once the cup seals have set isolating the wellbore interval between the cup seals, this unperforated isolated zone will become pressurized, allowing abrasive fluid to be delivered at high pressures through the jet perforating nozzles. Accordingly, new perforations will be jetted below the isolated interval. The tool assembly may then be moved downhole to isolate and treat the newly created perforations with the bypass valve closed.

When the anchor assembly is present, it is used to stabilize the location of the tool assembly during fracturing. Conversely, the anchor is typically not set during the sand jetting operation as the bypass valve remains open. However, upon initiating the sand jetting operation, fluid delivered to the tubing string will initially exit at the frac ports, setting the upper and lower cup seals against the casing. The set upper and lower cup seals thereby act as an anchor for the sand jetting operation, stabilizing the position of the tool assembly downhole to provide focussed perforations.

In some applications, a wellbore may contain existing perforations that require fracturing or other fluid treatment. However, additional perforations may also be required. The presently described completion tool provides the versatility to operate as a straddle isolation and treatment tool, and as a sand jet perforation device. That is, when the bypass valve is closed, the straddle isolation and treatment function is effectively selected. Should problems arise in the treatment of a particular zone, an additional perforation can be created within the zone with minimal time and cost simply by adjusting the position of the tool as appropriate, opening the bypass valve, and delivering abrasive perforation fluid to the tubing string. Once the interval has been re-perforated (by the jetting device), the tool string is moved to locate the cups about the new perforation and treatment may be resumed. Notably, this ability to adjust the treatment plan for the wellbore may be made on-site in real-time, not requiring new tools to be run in hole, or additional support personnel to be called to the site.

While the tool shown in the Figures incorporates a mechanical casing collar locator (MCCL), it will be understood that other depth control devices may be used, and also that the incorporation of a MCCL has a dual function in assisting actuation of the bypass plug and anchor device (if present). The locating fingers of the MCCL are typically intended to drag along the casing as the tool is moved up or downhole. As such, this drag provides a minimal degree of frictional resistance, which aids in driving the pin within the J slot in response to a mechanical force applied to the tubing from surface. On-site personnel will monitor the position of the pin within the J-slot, and exploit the drag of the MCCL in cycling the pin to the J slot position desired for actuation of the anchor device.

The above-described embodiments of the present invention are intended to be examples only. Each of the features, elements, and steps of the above-described embodiments may be combined in any suitable manner in accordance with the general spirit of the teachings provided herein. Alterations, modifications and variations may be effected by those of skill in the art without departing from the scope of the invention, which is defined solely by the claims appended hereto.

What is claimed is:

1. A completion tool for deployment within a wellbore on tubing string, the assembly comprising:

upper and lower sealing members defining a straddle zone between the upper and lower sealing members;

one or more treatment ports within the straddle zone, the treatment ports continuous with tubing string to allow fluid delivery to the wellbore from surface;

a valve housing mounted beneath the lower sealing member, the valve housing defining a fluid passageway continuous with the tubing string and with the wellbore annulus beneath the lower sealing member to allow pressure equalization therebetween;

a bypass plug slidable within the valve housing between an open position in which fluid passage through the housing is permitted, and a sealed position in which fluid passage through the housing is prevented, the plug actuable to open or to seal the passageway upon application of mechanical pressure to the tubing string; and a resettable anchor device operatively mounted beneath the lower sealing member for setting against the casing of a wellbore, the anchor device operable by application of mechanical force to the tubing string.

2. The completion tool as in claim 1, wherein the upper and lower sealing members are cup seals, inflatable sealing elements, or compressible sealing elements.

3. The completion tool as in claim 1, wherein the anchor device comprises one or more anchoring slips disposed about a mandrel of the anchor device, and an actuation cone slidable with respect to the mandrel of the anchor device to engage the inwardly biased slips and drive said slips outward to engage the casing, thereby anchoring the tool assembly against the casing.

4. The completion tool as in claim 3, wherein the anchor is actuated from surface by application of mechanical force to the tubing string, said mechanical force driving movement of a pin within an auto J profile, the auto J profile having pin stop positions corresponding to at least two slidable positions of the actuation cone.

5. The completion tool as in claim 1, wherein the anchor is actuated from surface by application of mechanical force to the tubing string.

6. The completion tool as in claim 5, wherein the application of mechanical force to the tubing string drives movement of a pin within an auto J profile, the auto J profile having pin stop positions corresponding to at least two operable positions of the anchor device.

7. The completion tool as in claim 1, wherein the anchor device further comprises a mechanical casing collar locator for providing frictional resistance against which the anchor device may be operated by application of mechanical force to the tubing string from surface.

8. The completion tool as in claim 1, further comprising one or more jet perforation nozzles formed within the assembly below the valve housing.

9. A completion tool for deployment within a wellbore on tubing string, the assembly comprising:

a straddle assembly comprising upper and lower sealing members defining a straddle zone;

one or more treatment ports within the straddle zone of the straddle assembly, the treatment ports continuous with tubing string to allow fluid delivery to the wellbore from surface;

a jet perforation device operatively attached below the straddle assembly, the jet perforation device comprising a tubular having one or more jet perforation nozzles continuous with the tubing string;

a valve housing between the straddle assembly and the jet perforation device, the valve housing defining a fluid passageway between the straddle assembly and the jet perforation device;

a bypass plug slidable within the valve housing between an open position in which fluid passage through the housing to the jet perforation device is permitted, and a sealed position in which fluid passage through the housing is prevented, the plug actuable to open or to seal the passageway upon application of mechanical pressure to the tubing string.

10. The completion tool as in claim 9, further comprising a resettable anchor device for engaging the casing of a wellbore, the anchor device operable by application of mechanical force to the tubing string.

11. The completion tool as in claim 10, wherein the anchor device comprises one or more inwardly biased anchoring slips disposed about a mandrel of the anchor device, and an actuation cone slidable with respect to the mandrel of the anchor device to engage the inwardly biased slips and drive said slips outward to engage the casing, thereby anchoring the tool assembly against the casing.

12. The completion tool as in claim 11, wherein the anchor is actuated from surface by application of mechanical force to the tubing string, said mechanical force driving movement of a pin within an auto J profile, the auto J profile having pin stop positions corresponding to at least two slidable positions of the actuation cone.

13. The completion tool as in claim 10, wherein application of mechanical force to the tubing string drives movement of a pin within an auto J profile, the auto J profile having pin stop positions corresponding to at least two operable positions of the anchor device.

14. The completion tool as in claim 10, wherein the anchor device further comprises a mechanical casing collar locator for providing frictional resistance against which the anchor device may be operated by application of mechanical force to the tubing string from surface.

15. A method for treating a wellbore, the method comprising the steps of:

providing a tool assembly comprising: upper and lower sealing members mounted along a mandrel, defining a straddle zone between the upper and lower sealing members; one or more treatment ports within the straddle zone for delivery of treatment fluid to the wellbore from the tubing string; a valve housing mounted beneath the lower sealing member, the valve housing defining a fluid passageway continuous with the tubing string and with the wellbore annulus beneath the lower sealing member to allow pressure equalization therebetween; a bypass plug slidable within the valve housing between an open position in which fluid passage through the housing is permitted, and a sealed position in which fluid passage through the housing is prevented, the plug actuable to open or to seal the passageway upon application of a mechanical force to the tubing string; and a resettable anchor device operatively mounted beneath the lower sealing member for engaging the casing of a wellbore, the anchor device operable by application of mechanical force to the tubing string;

locating the completion tool downhole at a position in which the upper and lower sealing members straddle a casing perforation to be treated;

sealing the fluid passageway through the valve housing;

applying mechanical force to the tubing string to set the anchor against the casing; and applying treatment fluid to the tubing string to isolate and treat the perforation.

16. The method as in claim 15, further comprising the step of unsealing the fluid passageway through the valve housing to equalize hydraulic pressure across the lower sealing member.

17. The method as in claim 15, further comprising the step of unsetting the anchor from the casing.

18. The method as in claim 15, wherein one or more steps of the method are repeated without removing the tool from the wellbore.

19. A method for treating a wellbore, the method comprising the steps of:

providing a completion tool comprising: a straddle assembly comprising upper and lower sealing members defining a straddle zone; one or more treatment ports within the straddle zone, the treatment ports continuous with tubing string to allow fluid delivery through the treatment ports from surface; a jet perforation device operatively attached below the straddle assembly, the jet perforation device comprising a tubular having one or more jet perforation nozzles continuous with the tubing string; a valve housing between the straddle assembly and the jet perforation device, the valve housing defining a fluid passageway between the straddle assembly and the jet perforation device; and a bypass plug for reversibly sealing the fluid passage through the housing, the plug operable upon application of mechanical pressure to the tubing string;

locating the completion tool downhole adjacent a zone of interest; and applying fluid to the tubing string.

20. The method as in claim 19, wherein the fluid passageway between the straddle assembly and the jet perforation device is sealed when fluid is applied to the tubing string such that the fluid is applied only to the wellbore adjacent the straddle zone.

21. The method as in claim 19, wherein the fluid passageway between the straddle assembly and the jet perforation device is unsealed when the fluid is applied to the tubing string, such that fluid is applied to the wellbore adjacent the straddle zone and also through nozzles in the jet perforation device.

22. The method as in claim 19, wherein the tool further comprises a resettable anchor device operatively attached beneath the lower cup seal, for engaging the casing of a wellbore to stabilize the tool within the casing, the anchor device operable by application of mechanical force to the tubing string; and wherein the method further comprises the step of applying mechanical force to the tubing string to set the anchor against the casing.

23. A method for perforating and treating a wellbore, the method comprising the steps of:

providing a tool assembly deployed on tubing string, the tool assembly comprising a straddle isolation device, a sand jet perforating device, and a fluid bypass valve between the isolation tool and the sand jet perforating device;

setting the straddle isolation device downhole about a perforation to be treated;

pumping fluid down the tubing string with the bypass valve closed, to prevent said fluid from reaching the jet perforation device;

once treatment of the perforation is complete, opening the bypass valve to allow hydraulic pressure to be dissipated across the straddle device.

24. The method as in claim 23, wherein the straddle isolation device comprises upper and lower cup seals about a straddle zone.

25. The method as in claim 23, further comprising the steps of:

identifying a wellbore interval to be perforated;

locating the bottom hole assembly within the wellbore interval to be perforated;

sealing the bypass valve;

pumping abrasive fluid down the tubing string through the jet perforation device to perforate the wellbore interval.

26. The method as in claim 23, wherein one or more steps of the method are repeated without removing the tool from the wellbore.

27. The method as in claim 23, wherein the tool further comprises a resettable anchor device for engaging the casing of a wellbore to stabilize the tool within the casing, the anchor device operable by application of mechanical force to the tubing string; and wherein the method further comprises the step of applying mechanical force to the tubing string to set the anchor against the casing.

* * * * *